US008038592B2

(12) United States Patent
Toi et al.

(10) Patent No.: US 8,038,592 B2
(45) Date of Patent: Oct. 18, 2011

(54) CENTRIFUGE HAVING FACE SEAL

(75) Inventors: Hiroatsu Toi, Hitachinaka (JP); Eiichi Fukuhara, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 56 days.

(21) Appl. No.: 12/565,924

(22) Filed: Sep. 24, 2009

(65) Prior Publication Data

US 2010/0075823 A1 Mar. 25, 2010

(30) Foreign Application Priority Data

Sep. 25, 2008 (JP) ..... 2008-245586

(51) Int. Cl.
*B04B 15/02* (2006.01)

(52) U.S. Cl. ..... 494/2; 494/14; 494/41; 494/42

(58) Field of Classification Search ..... 494/1–2, 494/11–15, 23–30, 35, 38, 39, 41–43, 61, 494/85; 277/930; 422/26
See application file for complete search history.

(56) References Cited

U.S. PATENT DOCUMENTS 3,103,489 A * 9/1963 Pickels ..... 494/14
3,129,174 A * 4/1964 Pickels et al. ..... 494/1
3,195,809 A * 7/1965 Pickels et al. ..... 494/1
3,292,937 A * 12/1966 Nunley ..... 277/401
3,430,849 A * 3/1969 Nunley et al. ..... 494/12
3,602,425 A * 8/1971 Schmidt ..... 494/14
3,604,769 A * 9/1971 Latham, Jr. ..... 384/476
4,011,972 A * 3/1977 Pederson et al. ..... 494/41
4,810,240 A * 3/1989 Zuccato ..... 494/14
5,356,365 A * 10/1994 Brierton ..... 494/14
6,607,473 B2 * 8/2003 Collier ..... 494/37
6,935,771 B2 * 8/2005 Engel ..... 366/331
7,144,361 B2 * 12/2006 Aizawa et al. ..... 494/38
7,396,324 B2 * 7/2008 Tetsu et al. ..... 494/7
7,591,775 B2 * 9/2009 Tobita et al. ..... 494/14
7,794,383 B2 * 9/2010 Tetsu et al. ..... 494/7
7,837,609 B2 * 11/2010 Merino et al. ..... 494/60
7,862,494 B2 * 1/2011 Merino et al. ..... 494/60
7,874,973 B2 * 1/2011 Akatsu et al. ..... 494/14
7,901,342 B2 * 3/2011 Tobita et al. ..... 494/14
7,909,751 B2 * 3/2011 Tobita et al. ..... 494/37
2003/0114289 A1 * 6/2003 Merino et al. ..... 494/37
2004/0214711 A1 * 10/2004 Aizawa et al. ..... 494/79
2005/0107235 A1 * 5/2005 Tetsu et al. ..... 494/10

(Continued)

FOREIGN PATENT DOCUMENTS

JP 2006-247610 9/2006

(Continued)

*Primary Examiner* — Charles E Cooley
(74) *Attorney, Agent, or Firm* — Antonelli, Terry, Stout & Kraus, LLP.

(57) ABSTRACT

A centrifuge includes a rotor, a rotation shaft which has a through-hole communicated with an interior of the rotor, a face seal which slidingly contacts an end of the rotation shaft and has a path communicated with the through-hole of the rotation shaft, a wall member which accommodates the face seal, a sample transfer unit which transfers a sample through the rotor, and a coolant circulation unit which circulates a coolant to the wall member. The sample transfer unit transfers the sample by pressure so that a pressure of the sample flowing through a portion where the rotation shaft and the face seal slidingly contact with each other is higher than a pressure of the coolant flowing through the wall member.

18 Claims, 4 Drawing Sheets

U.S. PATENT DOCUMENTS

| | | | | |
|---|---|---|---|---|
| 2005/0215410 | A1* | 9/2005 | Merino et al. | 494/37 |
| 2006/0009341 | A1* | 1/2006 | Tobita et al. | 494/14 |
| 2008/0251436 | A1* | 10/2008 | Tetsu et al. | 210/145 |
| 2008/0300124 | A1* | 12/2008 | Akatsu et al. | 494/14 |
| 2009/0239729 | A1* | 9/2009 | Tobita et al. | 494/14 |
| 2010/0075823 | A1* | 3/2010 | Toi et al. | 494/6 |

FOREIGN PATENT DOCUMENTS

| | | | |
|---|---|---|---|
| JP | 2006247610 A | * | 9/2006 |
| JP | 200945557 | * | 3/2009 |
| JP | 2009262104 A | * | 11/2009 |
| JP | 2010075815 A | * | 4/2010 |

* cited by examiner

CENTRIFUGE HAVING FACE SEAL

BACKGROUND OF THE INVENTION

1. Field of the Invention

The present invention relates to a centrifuge, and more particularly, a centrifuge which continuously performs centrifugal separation on a sample.

2. Description of the Related Art

Centrifuges are used for separating particles which do not, or do not easily, settle out in a normal gravitational field. Particles separated by centrifuges include viruses and fungus bodies which are necessary materials for producing medicines and vaccines. In a production process of medicines and vaccines, continuous flow centrifuges which can continuously separate and refine materials are used.

Continuous flow centrifuges have a face seal which abuts a rotation shaft of a rotor. The face seal is supported by a spring so as to contact the rotation shaft with a constant pressure. In order to cool down the face seal which generates heat due to friction with the rotation shaft, a coolant is circulated around the periphery of the face seal.

Unexamined Japanese Patent Application KOKAI Publication No. 2006-247610 discloses a continuous flow centrifuge which has a face seal held by two kinds of O-rings formed of different materials. According to such a continuous flow centrifuge, it is possible to prevent a contamination of a sample with a coolant due to a seal defect caused by a swelling of an O-ring.

The face seal has a lifetime and needs to be replaced, in general, after about 40 to 50 hours of operation, even though it is cooled down by a coolant. When the face seal is continuously used beyond its lifetime, a sealing property between the rotation shaft of the rotor and the face seal is lost, so that it becomes difficult to isolate a sample from the coolant. Accordingly, the sample may be contaminated by the coolant, and may become improper to use.

SUMMARY OF THE INVENTION

The present invention has been made in view of the foregoing problem, and it is an object of the present invention to provide a centrifuge which can prevent a contamination of a sample with a coolant even if a face seal loses its sealing property.

To achieve the object, a centrifuge according to the first aspect of the present invention comprises:

a hollow rotor which separates a sample thereinside;

a first rotation shaft which is provided at one end of the rotor so as to be coaxial with a rotation axis of the rotor, and has a through-hole communicated with an interior of the rotor;

a second rotation shaft which is provided at the other end of the rotor so as to be coaxial with the rotation axis of the rotor, and has a through-hole communicated with the interior of the rotor;

a first face seal which slidingly contacts an end of the first rotation shaft, and has a first path communicated with the through-hole of the first rotation shaft;

a first wall member which accommodates the first face seal;

a second face seal which slidingly contacts an end of the second rotation shaft, and has a second path communicated with the through-hole of the second rotation shaft;

a second wall member which accommodates the second face seal;

a sample transfer unit which supplies the sample from the first path into the rotor, and discharges the sample from the rotor to the second path; and a coolant circulation unit which circulates a coolant to the first wall member and the second wall member, and wherein the sample transfer unit transfers the sample by pressure so that a pressure of the sample flowing through a portion where the first rotation shaft and the first face seal slidingly contact with each other is higher than a pressure of the coolant flowing through the first wall member, and a pressure of the sample flowing through a portion where the second rotation shaft and the second face seal slidingly contact with each other is higher than a pressure of the coolant flowing through the second wall member.

It is desirable that the centrifuge further comprises:

a first biasing member which biases the first face seal toward the first rotation shaft; and a second biasing member which biases the second face seal toward the second rotation shaft.

It is desirable that the sample transfer unit comprises a pump which transfers the sample by pressure.

It is desirable that the sample transfer unit comprises a pressure control unit which is provided at a downstream side of the second path and which controls the pressure of the sample.

It is desirable that the pressure control unit is a valve for controlling a flow rate of the sample.

It is desirable that the sample transfer unit comprises a pressure detection unit which is provided at a downstream side of the second path and which detects the pressure of the sample.

It is desirable that the coolant circulation unit comprises a pump which transfers the coolant by pressure.

It is desirable that the coolant circulation unit comprises a flow-rate control unit which controls a flow rate of the coolant.

Furthermore, to achieve the object, a centrifuge according to the second aspect of the present invention comprises:

a hollow rotor which separates a sample thereinside;

a first rotation shaft which is provided at one end of the rotor so as to be coaxial with a rotation axis of the rotor, and has a through-hole communicated with an interior of the rotor;

a face seal which slidingly contacts an end of the first rotation shaft, and has a first path communicated with the through-hole of the first rotation shaft;

a wall member which accommodates the face seal;

a second rotation shaft which is provided at the other end of the rotor so as to be coaxial with the rotation axis of the rotor, and has a second path communicated with the interior of the rotor;

a sample transfer unit which supplies the sample from one of the first path and the second path into the rotor, and discharges the sample from the rotor to the other of the first path and the second path; and a coolant circulation unit which circulates a coolant to the wall member, and wherein the sample transfer unit transfers the sample by pressure so that a pressure of the sample flowing through a portion where the first rotation shaft and the face seal slidingly contact with each other is higher than a pressure of the coolant flowing through the wall member.

It is desirable that the centrifuge further comprises a biasing member which biases the face seal toward the first rotation shaft.

It is desirable that the sample transfer unit comprises a pump which transfers the sample by pressure.

It is desirable that the sample transfer unit comprises a pressure control unit which is provided at a downstream side of the first path and the second path and which controls the pressure of the sample.

It is desirable that the pressure control unit is a valve for controlling a flow rate of the sample.

It is desirable that the sample transfer unit comprises a pressure detection unit which is provided at a downstream side of the first path and the second path and which detects the pressure of the sample.

It is desirable that the coolant circulation unit comprises a pump which transfers the coolant by pressure.

It is desirable that the coolant circulation unit comprises a flow-rate control unit which controls a flow rate of the coolant.

Furthermore, to achieve the object, a centrifuge according to the third aspect of the present invention comprises:

a hollow rotor which separates a sample thereinside;

a rotation shaft which is provided at an end of the rotor so as to be coaxial with a rotation axis of the rotor, and has a through-hole communicated with an interior of the rotor;

a face seal which slidingly contacts an end of the rotation shaft, and has a path communicated with the through-hole of the rotation shaft;

a wall member which accommodates the face seal;

a sample transfer unit which supplies the sample from the path into the rotor, or discharges the sample from the rotor to the path; and a coolant circulation unit which circulates a coolant to the wall member, and wherein the sample transfer unit transfers the sample by pressure so that a pressure of the sample flowing through a portion where the rotation shaft and the face seal slidingly contact with each other is higher than a pressure of the coolant flowing through the wall member.

It is desirable that the centrifuge further comprises a biasing member which biases the face seal toward the rotation shaft.

According to the present invention, it becomes possible to prevent a contamination of a sample with a coolant even if a face seal loses its sealing property.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENT

An explanation will be given of a preferred embodiment of the present invention with reference to accompanying drawings. Although the following embodiment contains various limitations technically preferable to carry out the present invention, it should be understood that the scope of the present invention should not be limited to the following embodiment and illustrated examples.

Figure 1:
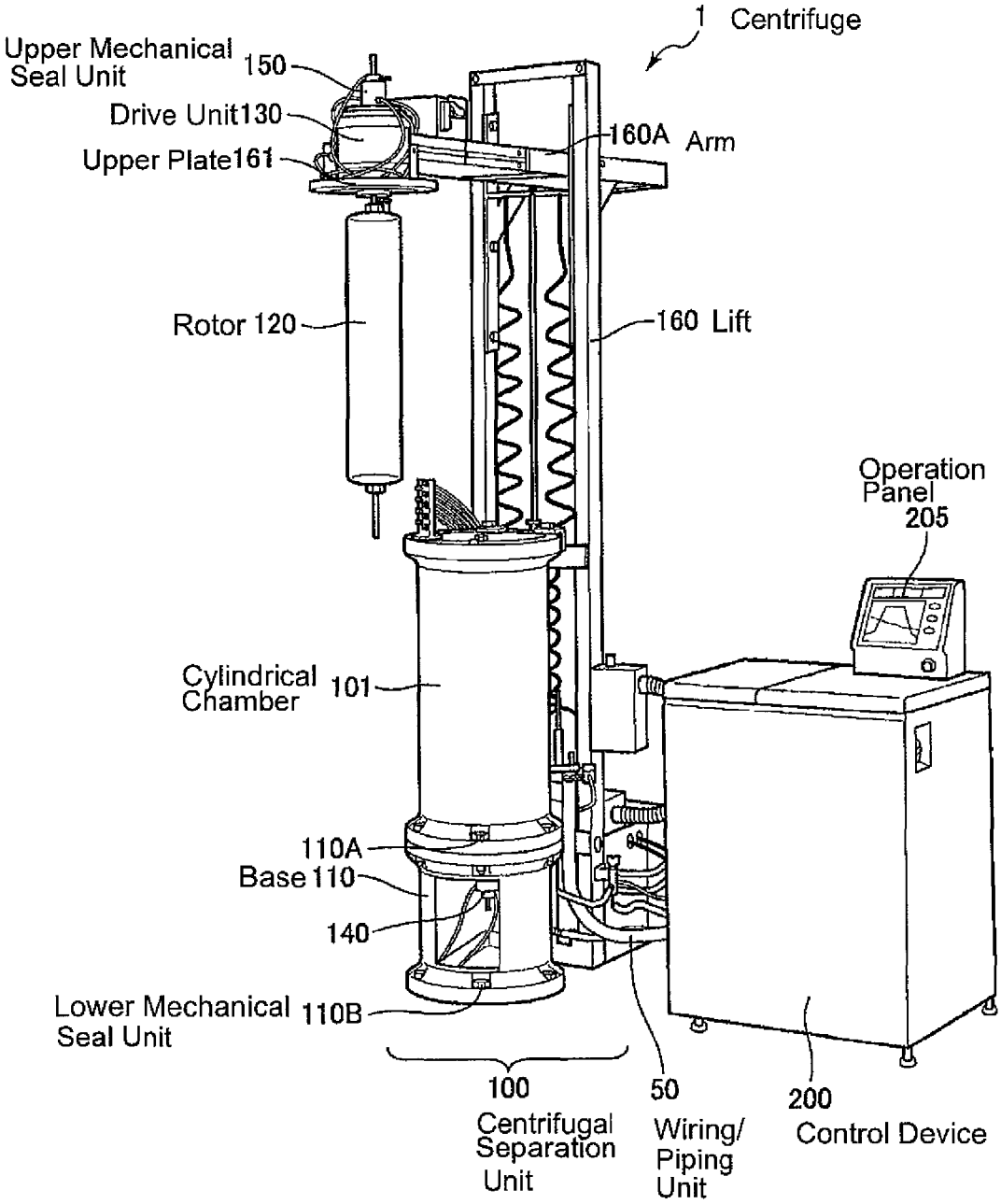
FIG. 1 is a perspective view showing a centrifuge according to an embodiment of the present invention.

A centrifuge 1 shown in FIG. 1 is a continuous flow ultracentrifuge which is used for, for example, a vaccine production process. The centrifuge 1 includes a centrifugal separation unit 100 and a control device unit 200. The centrifugal separation unit 100 and the control device unit 200 are connected together via a wiring/piping group 50.

The centrifugal separation unit 100 has a cylindrical chamber 101 configuring a centrifugation room, a base 110 supporting the chamber 101, a rotor 120 which can be put into and taken out from the chamber 101, a drive unit 130 which rotates the rotor 120 hung thereon, a lower mechanical seal unit 140 attached below the chamber 101, an upper mechanical seal unit 150 attached above the drive unit 130, a lift 160 which moves the drive unit 130 up, down, back, and forth, a sample transfer unit 170 (see FIG. 2) which continuously supplies and discharges a sample into and from the rotor 120, and a coolant circulation unit 180 (see FIG. 5) which cools down the lower mechanical seal unit 140 and the upper mechanical seal unit 150.

Figure 2:
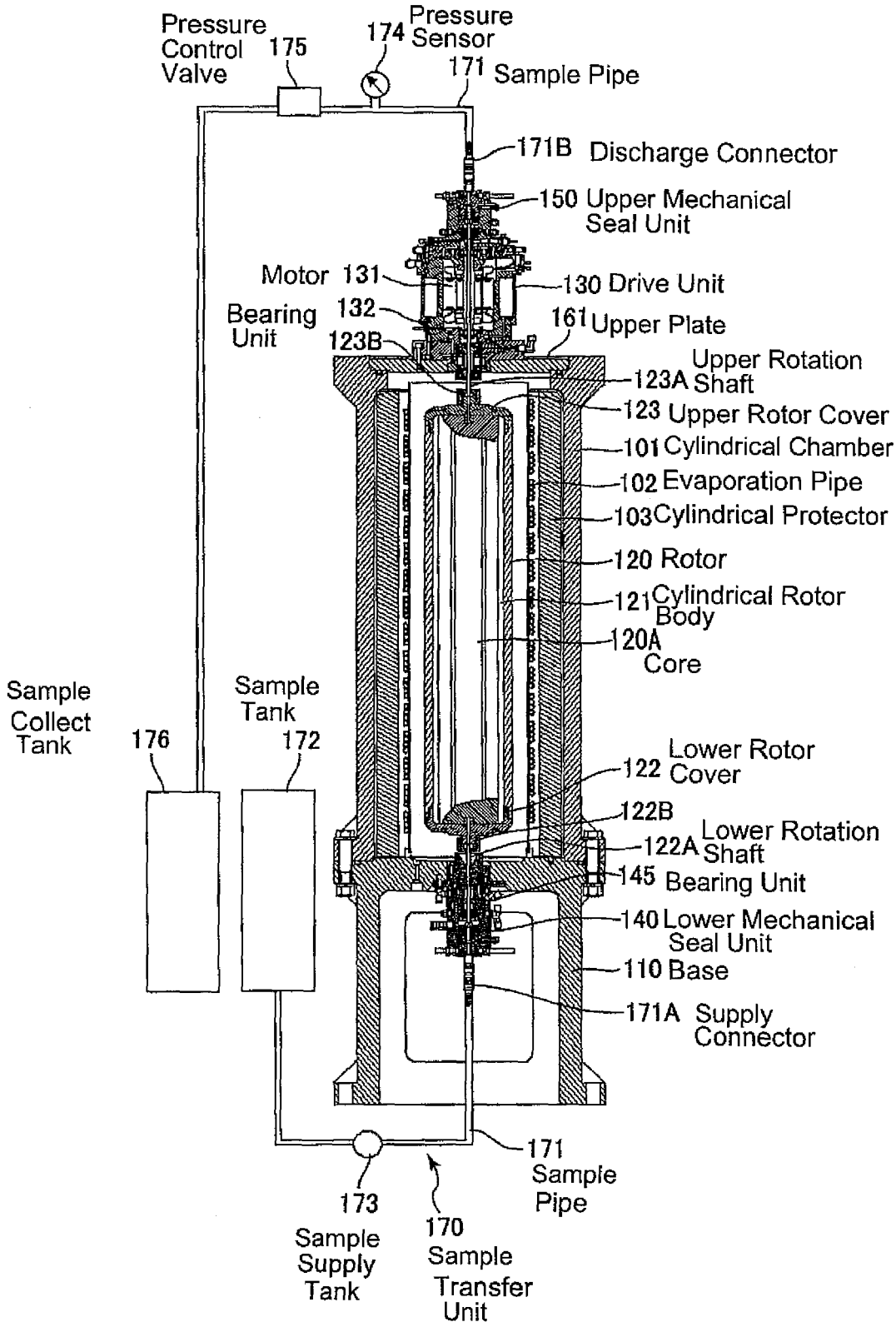
FIG. 2 is a cross-sectional view showing a centrifugal separation unit of the centrifuge of the embodiment.

As shown in FIG. 1, the chamber 101 is mounted on the base 110, and is fixed thereto by plural bolts 110A. As shown in FIG. 2, the chamber 101 can accommodate the rotor 120 hung on the drive unit 130. A cylindrical evaporator (evaporation pipe) 102 which covers the periphery of the rotor 120, and a cylindrical protector 103 which covers the periphery of the evaporator 102, are provided inside the chamber 101.

The evaporator 102 includes a copper pipe through which a refrigerant gas flows, and functions to cool down the interior of the chamber 101.

The protector 103 has a function as a safety shield which prevents, when the rotor 120 breaks because of some reasons while rotating, a piece of the broken rotor 120 or a sample from flying out to the exterior of the chamber 101.

The chamber 101 has a non-illustrated air discharge port formed at a barrel portion thereof to reduce the pressure inside the chamber 101. As the interior of the chamber 101 is subjected to pressure reduction, it is possible to suppress windage loss and heat generation of the rotor 120, which rotates at high speed, due to friction with air.

As shown in FIG. 1, the base 110 is fixed to a floor surface by plural bolts 110B. As shown in FIG. 2, a bearing unit 145 which rotatably supports the rotor 120 is fixed to the base 110.

The rotor 120 includes a cylindrical rotor body 121, and upper and lower rotor covers 123, 122 screwed in and fixed to upper and lower ends of the rotor body 121, respectively. Sample passing holes which are communicated with the interior of the rotor 120 are formed in respective axial centers of the upper rotor cover 123 and the lower rotor cover 122. An upper rotation shaft 123A and a lower rotation shaft 122A are attached to axial centers of the upper rotor cover 123 and the lower rotor cover 122 by a nut 123B and a nut 122B, respectively. Sample passing holes are formed in respective axial centers of the upper rotation shaft 123A and the lower rotation shaft 122A, and are communicated with respective sample passing holes formed in the upper rotor cover 123 and the lower rotor cover 122. The upper rotation shaft 123, the rotor 120, and the lower rotation shaft 122A rotate in an integrated manner, as a motor 131 of the drive unit 130 to be discussed later rotates the upper rotation shaft 123.

The rotor 120 accommodates a core 120A which can be put in and taken out from the interior of the rotor 120. The core 120A has a function of moving a sample to a high-centrifugal-force field apart from the axial center of the rotor 120. Accordingly, a sample supplied from the sample passing hole of the lower rotation shaft 122A into the rotor 120 is divided into a deposit and a supernatant at the high-centrifugal-force field. The deposit separated from the sample remains in the rotor 120, while the supernatant separated from the sample is discharged from the sample passing hole of the upper rotation shaft 123A.

The drive unit 130 is attached to an upper plate 161. The upper plate 161 is attached to an end of an arm 160A of the lift 160. The drive unit 130 includes the motor 131, a bearing unit 132, and the like. The motor 131 has an output shaft which is the upper rotation shaft 123A. The bearing unit 132 rotatably supports the upper rotation shaft 123A above and below the motor 131. As the drive unit 130 holds the upper rotation shaft 123A fixed to the rotor 120, the rotor 120 is hung on the drive unit 130.

Figure 3:
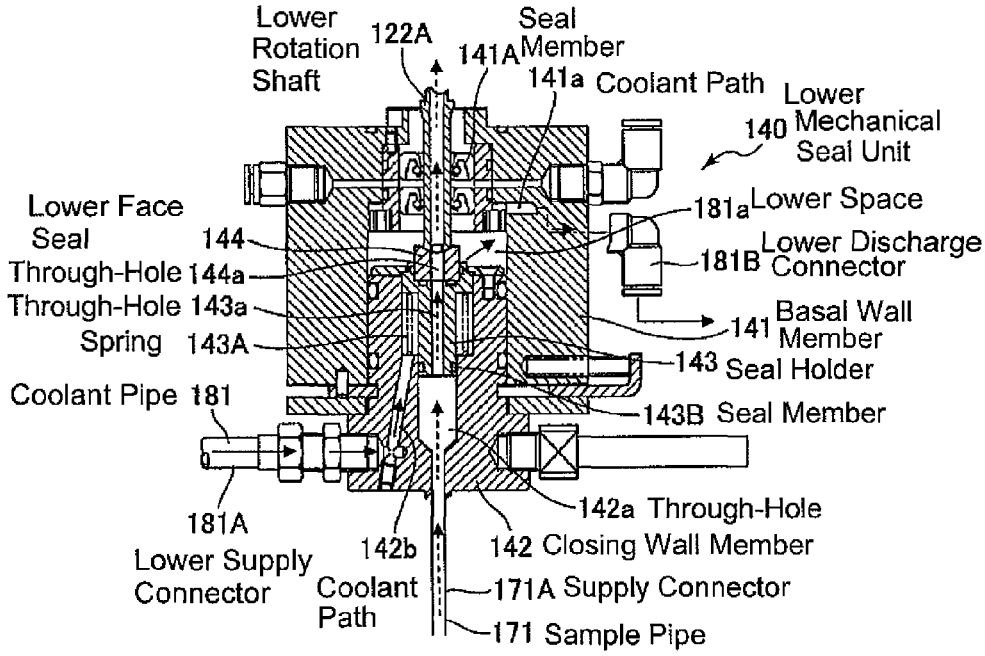
FIG. 3 is a cross-sectional view showing a lower mechanical seal unit of the centrifuge of the embodiment.

As shown in FIG. 2, the lower mechanical seal unit 140 is attached to a bearing unit 145 fixed to the base 110. As shown in FIG. 3, the lower mechanical seal unit 140 mainly includes a basal wall member 141, a closing wall member 142, a seal holder 143, and a lower face seal 144.

The basal wall member 141 is formed in a cylindrical shape having a through-hole, and is fixed to the base 110 in such a way that the lower rotation shaft 122A extending from the rotor 120 is inserted into the through-hole. A seal member 141A which rotatably supports the lower rotation shaft 122A and has water-tightness is provided at the rotor-120 side in the through-hole of the basal wall member 141. The basal wall member 141 also has a coolant path 141*a* which is open below the seal member 141A in the through-hole. The coolant path 141*a* is connected to a lower discharge connector 181B of a coolant pipe 181 to be discussed later.

The closing wall member 142 is formed in a cylindrical shape having a through-hole 142*a*, is fitted into the through-hole of the basal wall member 141 from a side opposite to the rotor 120, and is fixed to the basal wall member 141. The basal wall member 141 and the closing wall member 142 define a lower space 181*a* in the through-hole of the basal wall member 141. Seal members having water-tightness are provided at a fitting portion of the basal wall member 141 and the closing wall member 142. The through-hole 142*a* of the closing wall member 142 is formed so as to be substantially coaxial with the lower rotation shaft 122A, and has a larger-diameter part formed at the lower-space-181*a* side and a smaller-diameter part formed at a lower-end side of the closing wall member 142. The smaller-diameter part of the through-hole 142*a* is connected to a supply connector 171A of a sample pipe 171 to be discussed later, and functions as a sample passing hole. The closing wall member 142 also has a coolant path 142*b* which is open to the larger-diameter part of the through-hole 142*a*. The coolant path 142*b* is connected to a lower supply connector 181A of the coolant pipe 181 to be discussed later.

The seal holder 143 is formed in a cylindrical shape having a through-hole 143*a*, is inserted into the through-hole 142*a* of the closing wall member 142 from the rotor-120 side, and is fitted into the smaller-diameter part of the through-hole 142*a*. A seal member 143B having water-tightness is provided at a fitting portion of the smaller-diameter part of the through-hole 142*a* and the seal holder 143, so that water-tightness between the larger-diameter part and the smaller-diameter part of the through-hole 142*a* is ensured. The through-hole 143*a* is formed so as to be substantially coaxial with the lower rotation shaft 122A and the through-hole 142*a*. The through hole 143*a* has one end communicated with the smaller-diameter part of the through-hole 142*a*, and has another end communicated with the lower space 181*a*. The seal holder 143 is biased toward the rotor 120 by a spring 143A accommodated in the larger-diameter part of the through-hole 142*a*. Because a gap is formed between the larger-diameter part of the through-hole 142*a* and the seal holder 143, a coolant supplied from the coolant path 142*b* can flow into the lower space 181*a* through the gap between the larger-diameter part of the through-hole 142*a* and the seal holder 143.

The lower face seal 144 is provided at the rotor-120 side of the seal holder 143, and has a through-hole 144*a* which is substantially coaxial with the lower rotation shaft 122A and the through-hole 143*a* of the seal holder 143. The lower face seal 144 is formed of a material having a low friction coefficient such as a fluorine resin. An end of the lower rotation shaft 122A is positioned at a side of the lower face seal 144 opposite to the seal holder 143. Because the lower face seal 144 is biased toward the rotor 120 by the spring 143A via the seal holder 143, the lower face seal 144 abuts the lower rotation shaft 122A, and the through-hole 144*a* is communicated with the sample passing hole of the lower rotation shaft 122A with water-tightness. Because the lower face seal 144 is attached to the seal holder 143, as the lower rotation shaft 122A rotates, the lower face seal 144 and the lower rotation shaft 122A generate friction while retaining the water-tightness.

As explained above, the lower space 181*a* is defined by the basal wall member 141 and the closing wall member 142, and is hermetically sealed except the coolant paths 141*a*, 142*b*. The lower face seal 144 accommodated in the lower space 181*a* is cooled down by a coolant filled in the lower space 181*a*.

Figure 4:
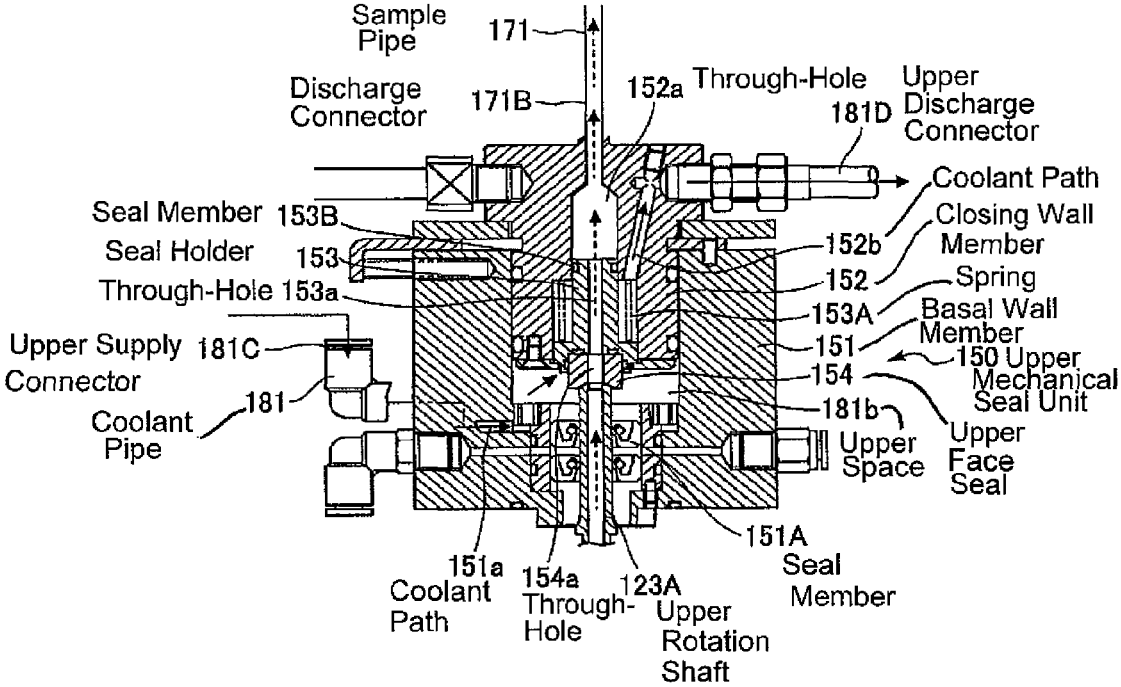
FIG. 4 is a cross-sectional view showing an upper mechanical seal unit of the centrifuge of the embodiment.

As shown in FIG. 2, the upper mechanical seal unit 150 is mounted on the drive unit 130. As shown in FIG. 4, the upper mechanical seal unit 150 mainly includes a basal wall member 151, a closing wall member 152, a seal holder 153, and an upper face seal 154.

The basal wall member 151 is formed in a cylindrical shape having a through-hole, and is fixed above the drive unit 130 in such a way that the upper rotation shaft 123A extending from the rotor 120 is inserted into the through-hole. A seal member 151A which rotatably supports the upper rotation shaft 123A and has water-tightness is provided at the rotor-120 side in the through-hole of the basal wall member 151. The basal wall member 151 also has a coolant path 151*a* which is open above the seal member 151A in the through-hole. The coolant path 151*a* is connected to an upper supply connector 181C of the coolant pipe 181 to be discussed later.

The closing wall member 152 is formed in a cylindrical shape having a through-hole 152*a*, is fitted into the through-hole of the basal wall member 151 from a side opposite to the rotor 120, and is fixed to the basal wall member 151. An upper space 181*b* is defined by the basal wall member 151 and the closing wall member 152 in the through-hole of the basal wall member 151. Seal members having water-tightness are provided at an fitting portion of the basal wall member 151 and the closing wall member 152. The through-hole 152*a* of the closing wall member 152 is formed so as to be substantially coaxial with the upper rotation shaft 123A, and has a larger-diameter part formed at the upper-space-181*b* side and a smaller-diameter part formed at an upper-end side of the closing wall member 152. The smaller-diameter part of the through-hole 152*a* is connected to a discharge connector 171B of the sample pipe 171 to be discussed later, and functions as a sample passing hole. The closing wall member 152 also has a coolant path 152*b* which is open to the larger-diameter part of the through-hole 152*a*. The coolant path 152*b* is connected to upper discharge connector 181D of the coolant pipe 181 to be discussed later.

The seal holder 153 is formed in a cylindrical shape having a through-hole 153*a*, is inserted into the through-hole 152*a* of the closing wall member 152 from the rotor-120 side, and is fitted into the smaller-diameter part of the through-hole 152*a*. A seal member 153B having water-tightness is provided at a fitting portion of the smaller-diameter part of the through-hole 152*a* and the seal holder 153, so that water-tightness between the larger-diameter part and the smaller-diameter part of the through-hole 152*a* is ensured. The through-hole 153*a* is formed so as to be substantially coaxial with the upper rotation shaft 123A and the through-hole 152*a*. The through-hole 153*a* has one end communicated with the smaller-diameter part of the through-hole 152*a*, and another end communicated with the upper space 181*b*. The seal holder 153 is biased toward the rotor 120 by a spring 153A accommodated in the larger-diameter part of the through-hole 152*a*. Because a gap is formed between the larger-diameter part of the through-hole 152*a* and the seal holder 153, a coolant supplied into the upper space 181*b* can be discharged from the coolant path 152*b* through the gap between the larger-diameter part of the through-hole 152*a* and the seal holder 153.

The upper face seal 154 is provided at a rotor-120 side of the seal holder 153, and has a through-hole 154*a* which is substantially coaxial with the upper rotation shaft 123A and the through-hole 153*a* of the seal holder 153. The upper face seal 154 is formed of a material having a low friction coefficient such as a fluorine resin. An end of the upper rotation shaft 123A is positioned at a side of the upper face seal 154 opposite to the seal holder 153. Because the upper face seal 154 is biased toward the rotor 120 by the spring 153A via the seal holder 153, the upper face seal 154 abuts the upper rotation shaft 123A, and the through-hole 154*a* is communicated with the sample passing hole of the upper rotation shaft 123A with water-tightness. Because the upper face seal 154 is attached to the seal holder 153, as the upper rotation shaft 123A rotates, the upper face seal 154 and the upper rotation shaft 123A generate friction while retaining the water-tightness.

As explained above, the upper space 181*b* is defined by the basal wall member 151 and the closing wall member 152, and is hermetically sealed except the coolant paths 151*a*, 152*b*. The upper face seal 154 accommodated in the upper space 181*b* is cooled down by a coolant filled in the upper space 181*b*.

The lift 160 includes an arm 160A which is movable up and down and is slidable back and forth, and non-illustrated drive devices (hydraulic cylinders) which move and slide the arm 160A. The foregoing upper plate 161 is attached to the arm 160A. Accordingly, lift 160 has a function of moving the drive unit 130 fixed to the upper plate 161 up, down, back, and forth, and of putting and taking out the rotor 120 hung on the drive unit 130 into and from the chamber 101.

As shown in FIG. 2, the sample transfer unit 170 mainly includes the sample pipe 171, a sample tank 172, a sample supply pump 173, a pressure sensor 174, a pressure control valve 175, and a sample collect tank 176.

The sample pipe 171 connects between the sample tank 172 and the lower mechanical seal unit 140, and between the upper mechanical seal unit 150 and the sample collect tank 176. The sample pipe 171 and the lower mechanical seal unit 140 are connected together via the supply connector 171A, while the sample pipe 171 and the upper mechanical seal unit 150 are connected together via the discharge connector 171B.

The sample tank 172 stores a sample to be separated by the rotor 120.

The sample supply pump 173 is provided in the sample pipe 171 between the sample tank 172 and the lower mechanical seal unit 140, and transfers the sample supplied from the sample tank 172 to the rotor 120 by pressure.

The pressure sensor 174 is provided in the sample pipe 171 between the upper mechanical seal unit 150 and the sample collect tank 176, and has a function of detecting pressure of the sample (supernatant) discharged from the upper mechanical seal unit 150.

The pressure control valve 175 is provided in the sample pipe 171 between the pressure sensor 174 and the sample collect tank 176, has a function of adjusting a flow rate of the sample, and of controlling pressure of the sample (supernatant) in the upper mechanical seal unit 150.

The sample collect tank 176 reserves the sample (supernatant) separated by the rotor 120.

A flow path which is formed by the sample pipe 171, the sample supply pump 173, the lower mechanical seal unit 140, the bearing unit 145, the rotor 120, the upper mechanical seal unit 150, and the pressure control valve 175, and through which the sample flows between the sample tank 172 and the sample collect tank 176, is defined as a sample transfer line in the embodiment. In the sample transfer line, the flow path resistance in the rotor 120 is relatively large. Therefore, it is difficult to adjust the pressure of the sample in the downstream side of the rotor 120 to a desired value by merely changing the discharge pressure of the sample supply pump 173. Accordingly, by changing the open degree of the pressure control valve 175 in addition to the discharge pressure of the sample supply pump 173, it becomes easy to adjust the pressure of the sample in the downstream side of the rotor 120. In the embodiment, a pressure of the sample which flows through a portion where the lower face seal 144 and the lower rotation shaft 122A contact with each other in the lower space 181*a* of the lower mechanical seal unit 140 is adjusted to 0.05 to 0.1 MPa or so, and a pressure of the sample which flows through a portion where the upper face seal 154 and the upper rotation shaft 123A contact with each other in the upper space 181*b* of the upper mechanical seal unit 150 is adjusted to greater than or equal to 0.002 MPa or so.

Figure 5:
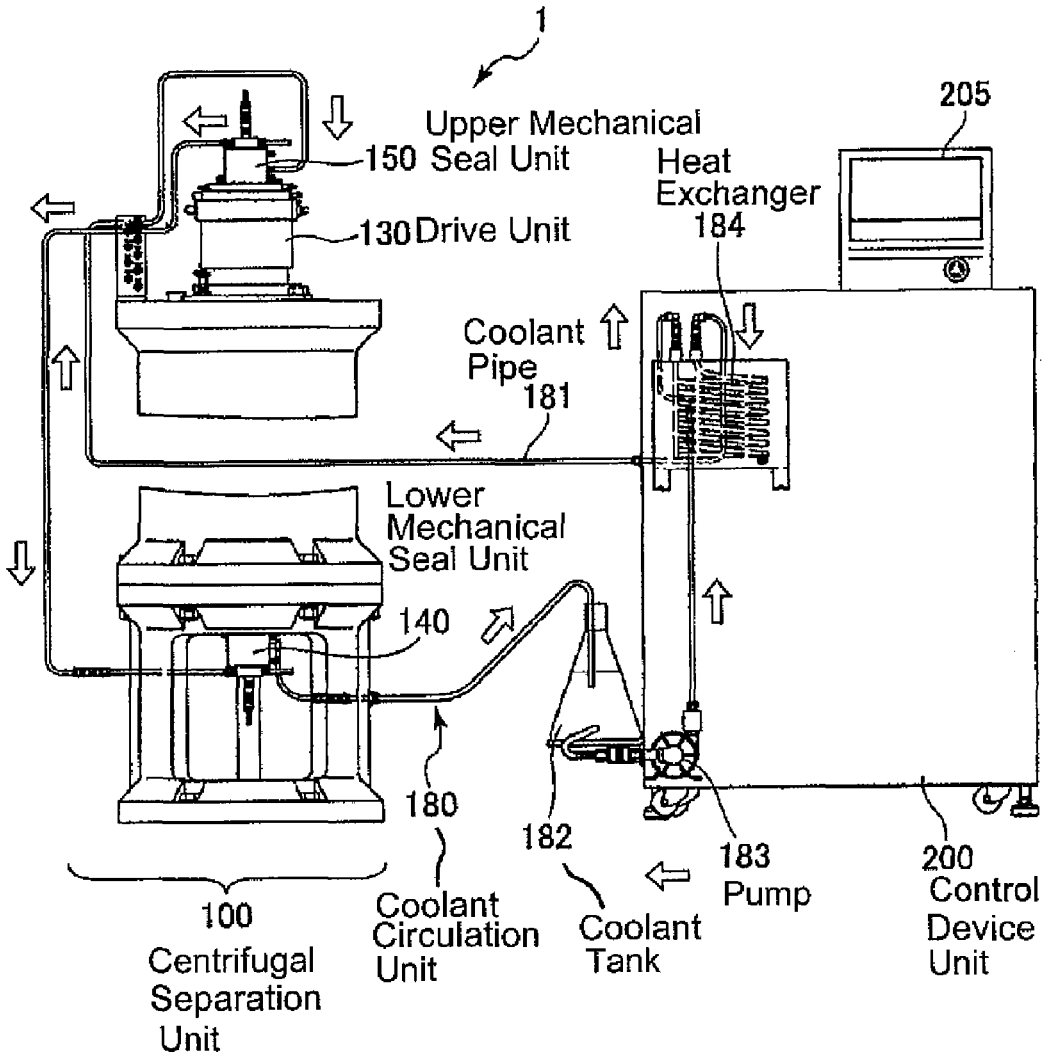
FIG. 5 is a schematic diagram showing a coolant circulation unit of the centrifuge of the embodiment.

As shown in FIG. 5, the coolant circulation unit 180 mainly includes the coolant pipe 181, a coolant tank 182, a coolant circulating pump 183, and a heat exchanger 184.

The coolant pipe 181 connects the coolant tank 182, the coolant circulating pump 183, the heat exchanger 184, the upper mechanical seal unit 150, and the lower mechanical seal unit 140 together.

The coolant tank 182 reserves a coolant to be supplied to the upper mechanical seal unit 150 and the lower mechanical seal unit 140.

The coolant circulating pump 183 has a non-illustrated flow-rate control valve, and transfers the coolant supplied from the coolant tank 182 to the heat exchanger 184 by pressure at a predetermined flow rate.

The heat exchanger 184 cools down the coolant supplied from the coolant circulating pump 183 to a predetermined temperature.

The coolant discharged from the heat exchanger 184 is supplied to the upper mechanical seal unit 150, contacts the upper face seal 154 accommodated in the upper space 181*b*, and cools down the upper face seal 154. Moreover, the coolant discharged from the upper mechanical seal unit 150 is supplied to the lower mechanical seal unit 140, contacts the lower face seal 144 accommodated in the lower space 181*a*, and cools down the lower face seal 144. The coolant discharged from the lower mechanical seal unit 140 is drained into the coolant tank 182.

A flow path which is formed by the coolant pipe 181, the coolant tank 182, the coolant circulating pump 183, the heat exchanger 184, the upper mechanical seal unit 150, and the lower mechanical seal unit 140, and through which the coolant flows, is defined as a coolant circulating line in the embodiment. In the embodiment, by adjusting the flow rate of the coolant discharged from the coolant circulating pump 183 to 400 ml/min or so, the pressure of the coolant flowing through the upper space 181*b* of the upper mechanical seal unit 150 and the lower space 181*a* of the lower mechanical seal unit 140 is adjusted to less than 0.002 MPa.

As shown in FIG. 5, the control device unit 200 accommodates the foregoing coolant circulating pump 183 and heat exchanger 184. The control device unit 200 further accommodates a non-illustrated refrigerator for cooling down the whole centrifugation room inside the chamber 101 (see FIG. 1), a non-illustrated vacuum pump for reducing the pressure of the centrifugation room inside the chamber 101, a non-illustrated lift drive device for moving the rotor 120 to a predetermined position, a non-illustrated electric control unit for driving and controlling the rotor 120, and the like. An operation panel 205 for operating the centrifuge 1 is arranged on the control device unit 200.

Next, an explanation will be given of how to perform centrifugal separation on the sample using the centrifuge 1.

First, the lift 160 is operated to move the rotor 120 in the chamber 101. Accordingly, as shown in FIG. 2, the upper plate 161 attached to a lower end face of the drive unit 130 is engaged with an upper end portion of the chamber 101, so that the centrifugation room inside the chamber 101 is hermetically sealed. Thereafter, the non-illustrated vacuum pump is activated to reduce the pressure of the centrifugation room inside the chamber 101, and the coolant circulating pump 183 and the heat exchanger 184 are activated to circulate the coolant.

Next, the sample supply pump 173 is activated to supply the sample to the rotor 120, and the motor 131 is driven to rotate the rotor 120. Accordingly, the rotor 120 continuously separates the supplied sample to a deposit and a supernatant. During this operation, the upper face seal 154 and the lower face seal 144 generating heat by friction with the upper rotation shaft 123A and the lower rotation shaft 122A, respectively, are cooled down by the coolant circulating the upper space 181*b* and the lower space 181*a*.

Note that even though the upper face seal 154 and the lower face seal 144 are both formed of a material having a low friction coefficient, those seals are gradually worn out because the rotation speed of the upper rotation shaft 123A and that of the lower rotation shaft 122A are high. Therefore, the upper face seal 154 and the lower face seal 144 need to be replaced after predetermined duration of use (e.g., fifty hours). If the upper face seal 154 and the lower face seal 144 are used beyond the predetermined duration, the sealing property between the upper rotation shaft 123A and the upper face seal 154, and between the lower rotation shaft 122A and the lower face seal 144 may eventually be lost.

According to the centrifuge 1 with the foregoing configuration, however, because the pressure of the sample (0.05 to 0.1 MPa or so) flowing through a portion where the lower face seal 144 and the lower rotation shaft 122A contact with each other is significantly higher than the pressure of the coolant (less than 0.002 MPa) flowing through the lower space 181*a*, it is possible to prevent the coolant from mixing in the sample flowing through the sample transfer line. Therefore, even if the sealing property between the lower rotation shaft 122A and the lower face seal 144 is lost, no contamination of the sample with the coolant occurs. Moreover, because the pressure of the sample (supernatant) (greater than or equal to 0.002 MPa) flowing through a portion where the upper face seal 154 and the upper rotation shaft 123A contact with each other in the upper space 181*b* of the upper mechanical seal unit 150 is higher than the pressure of the coolant (less than 0.002 MPa) flowing through the upper space 181*b*, it is possible to prevent the coolant from mixing in the sample (supernatant) flowing through the sample transfer line. Therefore, even if the sealing property between the upper rotation shaft 123A and the upper face seal 154 is lost, no contamination of the sample (supernatant) with the coolant occurs.

Because the flow path resistance in the rotor 120 is large, by providing the pressure control valve 175 at the downstream side of the rotor 120, the pressure of the sample flowing through a portion where the upper face seal 154 and the upper rotation shaft 123A contact with each other can be easily adjusted. The pressure control valve can be various kinds of valves, such as a ball valve, a needle valve, and a gate valve.

Moreover, because the flow path resistance in the rotor 120 is large, the pressure of the sample flowing through a portion where the upper face seal 154 and the upper rotation shaft 123A contact with each other is smaller than that of the sample flowing through a portion where the lower face seal 144 and the lower rotation shaft 122A contact with each other. Accordingly, there is a possibility that the sample is mixed with the coolant in the upper space 181*b* in comparison with the lower space 181*a*. Therefore, by providing the pressure sensor 174 at the downstream side of the upper mechanical seal unit 150, and by monitoring the pressure of the sample flowing through a portion where the upper face seal 154 contacts the upper rotation shaft 123A, it becomes possible to surely prevent a contamination of the sample with the coolant in the upper space 181*b*. The pressure sensor 174 can be various kinds of pressure gauges, such as a diaphragm type, and a bourdon tube type.

The present invention is not limited to the foregoing embodiment, and can be modified and changed within the scope of the present invention recited in claims.

For example, the sample transfer unit 170 transfers the sample from the lower mechanical seal unit 140 to the upper mechanical seal unit 150 in the embodiment. However, as far as the pressure of the sample flowing through a portion where the lower rotation shaft 122A and the lower face seal 144 slidingly contact with each other is higher than that of the coolant flowing through the interior of the lower space 181*a*, and the pressure of the sample flowing through a portion where the upper rotation shaft 123A and the upper face seal 154 slidingly contact with each other is higher than that of the coolant flowing through the interior of the upper space 181*b*, the sample transfer unit 170 may transfer the sample from the upper mechanical seal unit 150 to the lower mechanical seal unit 140.

Likewise, although the coolant circulation unit 180 transfers the coolant from the upper mechanical seal unit 150 to the lower mechanical seal unit 140 in the embodiment, the coolant circulation unit 180 may transfer the coolant from the lower mechanical seal unit 140 to the upper mechanical seal unit 150 by pressure. Moreover, although the coolant pipe 181 connects the upper mechanical seal unit 150 and the lower mechanical seal unit 140 in series in the embodiment, the coolant pipe 181 may connect those in parallel.

The flow-rate control valve for controlling the flow rate of the coolant is provided at the coolant circulating pump 183 in the embodiment. However, the flow-rate control valve may be provided separately from the coolant circulating pump 183.

The present invention is not limited to a vertical centrifuge, and can be applied to a horizontal centrifuge.

The materials, shapes, numbers, arrangement and the like of individual elements may be changed and modified as far as the object of the present invention can be accomplished.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2008-245586 filed on Sep. 25, 2008 and including specification, claims, drawings and summary. The disclosure of the above Japanese Patent Application is incorporated herein by reference in its entirety.

What is claimed is:

1. A centrifuge comprising:

a hollow rotor which separates a sample thereinside;

a first rotation shaft which is provided at one end of the rotor so as to be coaxial with a rotation axis of the rotor, and has a through-hole communicated with an interior of the rotor;

a second rotation shaft which is provided at the other end of the rotor so as to be coaxial with the rotation axis of the rotor, and has a through-hole communicated with the interior of the rotor;

a first face seal which slidingly contacts an end of the first rotation shaft, and has a first path communicated with the through-hole of the first rotation shaft;

a first wall member which accommodates the first face seal;

a second face seal which slidingly contacts an end of the second rotation shaft, and has a second path communicated with the through-hole of the second rotation shaft;

a second wall member which accommodates the second face seal;

a sample transfer unit which supplies the sample from the first path into the rotor, and discharges the sample from the rotor to the second path; and a coolant circulation unit which circulates a coolant to the first wall member and the second wall member, and wherein the sample transfer unit transfers the sample by pressure so that a pressure of the sample flowing through a portion where the first rotation shaft and the first face seal slidingly contact with each other is higher than a pressure of the coolant flowing through the first wall member, and a pressure of the sample flowing through a portion where the second rotation shaft and the second face seal slidingly contact with each other is higher than a pressure of the coolant flowing through the second wall member.

2. The centrifuge according to claim 1, further comprising:

a first biasing member which biases the first face seal toward the first rotation shaft;

a second biasing member which biases the second face seal toward the second rotation shaft.

3. The centrifuge according to claim 1, wherein the sample transfer unit comprises a pump which transfers the sample by pressure.

4. The centrifuge according to claim 1, wherein the sample transfer unit comprises a pressure control unit which is provided at a downstream side of the second path and which controls the pressure of the sample.

5. The centrifuge according to claim 4, wherein the pressure control unit is a valve for controlling a flow rate of the sample.

6. The centrifuge according to claim 1, wherein the sample transfer unit comprises a pressure detection unit which is provided at a downstream side of the second path and which detects the pressure of the sample.

7. The centrifuge according to claim 1, wherein the coolant circulation unit comprises a pump which transfers the coolant by pressure.

8. The centrifuge according to claim 1, wherein the coolant circulation unit comprises a flow-rate control unit which controls a flow rate of the coolant.

9. A centrifuge comprising:

a hollow rotor which separates a sample thereinside;

a first rotation shaft which is provided at one end of the rotor so as to be coaxial with a rotation axis of the rotor, and has a through-hole communicated with an interior of the rotor;

a face seal which slidingly contacts an end of the first rotation shaft, and has a first path communicated with the through-hole of the first rotation shaft;

a wall member which accommodates the face seal;

a second rotation shaft which is provided at the other end of the rotor so as to be coaxial with the rotation axis of the rotor, and has a second path communicated with the interior of the rotor;

a sample transfer unit which supplies the sample from one of the first path and the second path into the rotor, and discharges the sample from the rotor to the other of the first path and the second path; and a coolant circulation unit which circulates a coolant to the wall member, and wherein the sample transfer unit transfers the sample by pressure so that a pressure of the sample flowing through a portion where the first rotation shaft and the face seal slidingly contact with each other is higher than a pressure of the coolant flowing through the wall member.

10. The centrifuge according to claim 9, further comprising a biasing member which biases the face seal toward the first rotation shaft.

11. The centrifuge according to claim 9, wherein the sample transfer unit comprises a pump which transfers the sample by pressure.

12. The centrifuge according to claim 9, wherein the sample transfer unit comprises a pressure control unit which is provided at a downstream side of the first path and the second path and which controls the pressure of the sample.

13. The centrifuge according to claim 12, wherein the pressure control unit is a valve for controlling a flow rate of the sample.

14. The centrifuge according to claim 9, wherein the sample transfer unit comprises a pressure detection unit which is provided at a downstream side of the first path and the second path and which detects the pressure of the sample.

15. The centrifuge according to claim 9, wherein the coolant circulation unit comprises a pump which transfers the coolant by pressure.

16. The centrifuge according to claim 9, wherein the coolant circulation unit comprises a flow-rate control unit which controls a flow rate of the coolant.

17. A centrifuge comprising:

a hollow rotor which separates a sample thereinside;

a rotation shaft which is provided at an end of the rotor so as to be coaxial with a rotation axis of the rotor, and has a through-hole communicated with an interior of the rotor;

a face seal which slidingly contacts an end of the rotation shaft, and has a path communicated with the through-hole of the rotation shaft;

a wall member which accommodates the face seal;

a sample transfer unit which supplies the sample from the path into the rotor, or discharges the sample from the rotor to the path; and a coolant circulation unit which circulates a coolant to the wall member, and wherein the sample transfer unit transfers the sample by pressure so that a pressure of the sample flowing through a portion where the rotation shaft and the face seal slidingly contact with each other is higher than a pressure of the coolant flowing through the wall member.

18. The centrifuge according to claim 17, further comprising a biasing member which biases the face seal toward the rotation shaft.

* * * * *